United States Patent [19]

Buchanan

[11] 4,200,940

[45] May 6, 1980

[54] TOILET SEAT VOLATILE GAS INCINERATOR

[76] Inventor: Wes Buchanan, 2703 Pine Ave., Manhattan Beach, Calif. 90266

[21] Appl. No.: 960,463

[22] Filed: Nov. 13, 1978

[51] Int. Cl.[2] ..... E03D 9/05

[52] U.S. Cl. ..... 4/348; 4/221

[58] Field of Search ..... 4/348, 221, 213, 347, 4/136, 140; 219/368, 381, 374

[56] References Cited

U.S. PATENT DOCUMENTS

| | | | |
|---|---|---|---|
| 480,958 | 8/1892 | McKenzie | 4/221 |
| 3,482,395 | 12/1969 | Rando et al. | 219/381 |
| 3,887,949 | 6/1975 | Osmond | 4/213 |
| 4,085,470 | 4/1978 | Roberts | 4/213 |
| 4,099,047 | 7/1978 | Kirkland | 219/368 |
| 4,125,906 | 11/1978 | Weiland | 4/213 |

*Primary Examiner*—Lenard A. Footland
*Attorney, Agent, or Firm*—Singer & Singer

[57] ABSTRACT

The invention describes a system for removing the odors associated with the bodily discharge of odorous volatile gases associated with the use by the human body of the toilet stool. A hollow toilet seat having radial holes associated with the centermost portion is supported and communicates with a vacuum device for drawing air from the hollow portion through the radial holes through the ported toilet seat and through this vacuum device. An incinerating device such as a grid of tungsten wires or a glow plug is inserted in the passageway and connected to an electrical source, preferably one of low voltage, for incinerating and burning the odorous volatile body gases. The discharged by-products of combustion may either be discharged into the room or may be discharged through suitable wall fittings to the outside atmosphere. Incinerating the odorous volatile body gases destroys the odor allowing the by-products of combustion to be discharged back into the same bathroom atmosphere.

4 Claims, 2 Drawing Figures

TOILET SEAT VOLATILE GAS INCINERATOR

Figure 1:
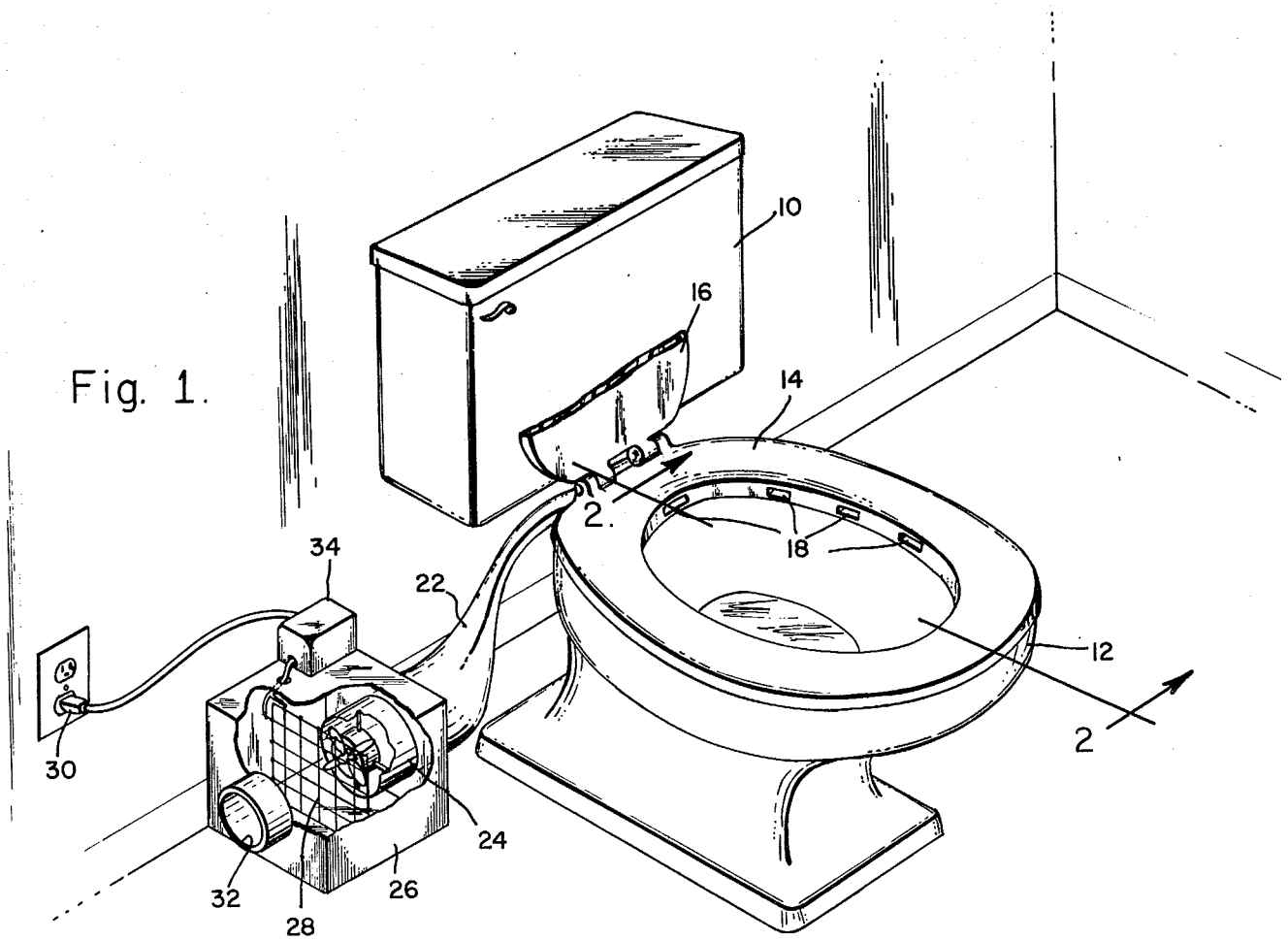

This invention relates to a system for permanently removing bathroom body odors by incinerating the odorous volatile body odors and then discharging the burned by-products of combustion either into the inside atmosphere or through suitable wall fittings to the outside atmosphere.

The prior art has recognized the problem of removing objectionable body odors from bathrooms as a means of making the bathroom and environs more pleasant and habitable.

The prior art has recognized that the human body utilizing a toilet stool for defecation purposes generates body odors that are considered by many to be objectionable.

The problem associated with high density living and the common practice of utilizing what in the trade is known as an inside bathroom with a small ventilating fan has compounded the problem and intensified the search for effective means for either eliminating and/or removing the obnoxious odors.

Unfortunately the prior art devices have only recognized a portion of the problem which is to remove the gases and to discharge the gases to some remote location or, in the alternative, to mask the gases by suitable masking agents. These masking agents unfortunately do not remove the gas but only generate an additional odor which has the effect of masking or covering the initial obnoxious smell with another smell that hopefully is less noxious and may be even pleasing. Masking devices are presently on the market and carry such fresh sounding names as Autumn Leaves, Minted Scent, Rose Fragrance, and the like, as a means of convincing the user that the new odor is in fact as fresh as the outdoors and is not obnoxious or objectionable.

A review of the prior art patents discloses many devices of the type mentioned above. For example, U.S. Pat. No. 3,913,150 entitled Toilet Stool Ventilating Means issued to Poister, et al, discloses a hollow toilet seat in combination with an electrically operated fan for drawing air from the hollow portion of the toilet seat through a filter to be discharged at some remote location. The Poister device simply takes the odorous gases from one location and discharges the same gases through a filter to some remote location. Unfortunately, discharging the air into the sewer vent as disclosed by Poister is not allowed in many municipalities and further, simply discharging the air to the outside atmosphere does not eliminate the problem when one recognizes the close proximity and high density living of the modern apartment and condominium dweller. In addition, the problem is not solved for the inside bathroom since the gas carrying the odor is not removed but simply discharged into another area.

U.S. Pat. No. 3,659,296 entitled Toilet Seat and issued to Stamper discloses still another variation of the hollow toilet seat used in combination with a fan for drawing away the odorous bodily gases. The Stamper device simply discloses the air be passed over a freshener device to "freshen or sweeten" the air. Devices of the Stamper type are common in the literature since they represent techniques for confining the obnoxious gas to a common area and either discharging it to a remote location or masking it by some sort of freshener, sweetener or filter which admittedly does not remove the gas but simply covers the smell.

The concept of ventilating the toilet stool by itself is admittedly old and in U.S. Pat. No. 470,740 issued to A. A. Bluhm on March 15, 1892, discloses a rudimentary system for ventilating the toilet seat in an effort to draw away the obnoxious bodily gases. A more modern system for ventilating a toilet seat is shown by W. Gudish in U.S. Pat. No. 2,728,088 issued Dec. 27, 1955. Admittedly these patents simply show ventilated toilet seats and a recognition of the problem that the odors associated with the use of the toilet stool are objectionable.

Until the advent of the present invention there has been no suitable system that recognizes the basic composition of the objectionable bodily gases and how to eliminate these gases as a means of eliminating the odor rather than masking the odor as is prevalent in the prior art devices.

Research and analysis has demonstrated that the objectionable gases discharged by the body are actually volatile gases and it is the volatile nature of the gas which some chemists believe has a methane base which gives the gas the objectionable odor. In other words, the odor is a direct result of the volatility of the gases and the present invention removes the volatile gas by incinerating the gas and thereby removes the gas and hence the objectionable odor.

In the present invention there is described a hollow toilet seat having an annular ring and radial holes communicating the annular opening with the hollow seat. A suitable vacuum pump connected to the hollow toilet seat is used to draw air from the annular opening through the radial openings of the toilet seat and through the hollow toilet seat itself.

An incinerating device preferably incorporating tungsten grid wires in the form of a mesh is placed in the air passageway and used to incinerate the odorous volatile bodily gases passng through the grid structure.

The odor-free by-products of combustion are then free to be discharged back into the atmosphere of the bathroom since all smells have been destroyed by the burning of the volatile gases. Where applicable the odor-free by-products of combustion may be discharged through a wall fitting to the outside atmosphere, thereby making the system applicable for inside bathrooms as well as for bathrooms having a common wall with the outside.

In the preferred embodiment a suitable pressure switch mounted on the bottommost side of the toilet seat may be used to turn the vacuum fan and the incinerator on as soon as a person utilizes the toilet seat. It is envisioned that either a 110 volt system may be used or in the interest of safety a step-down transformer reducing the total voltage to 12 volts may be used for operating the fan and the incinerating device.

Figure 2:
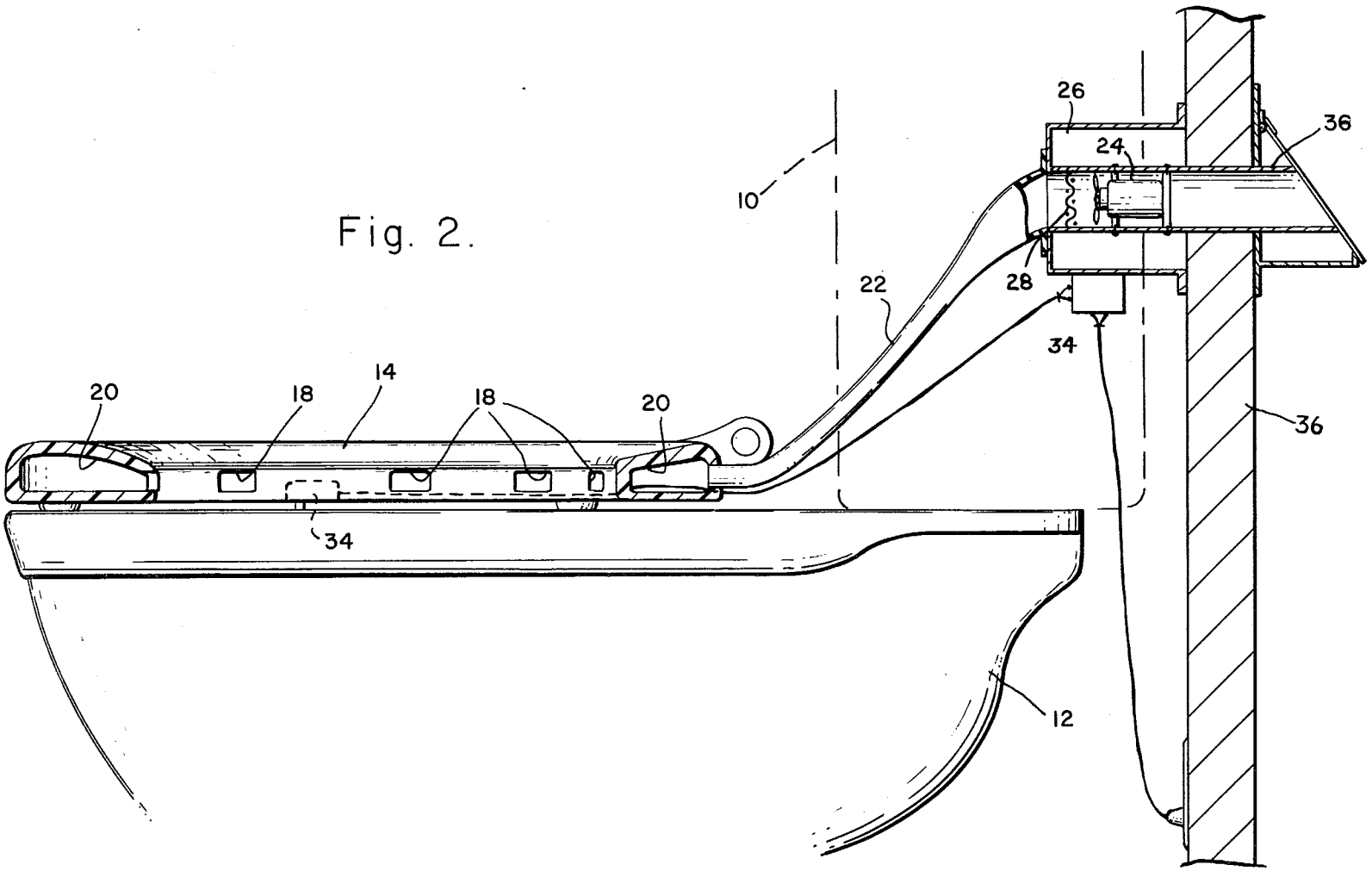

Further objects and advantages will be made more apparent by referring now to the accompanying drawings wherein:

FIG. 1 illustrates the present invention as used with a conventional toilet stool in a suitable bathroom; and FIG. 2 is a cross-section taken along lines 2—2 of FIG. 1.

Referring now to FIG. 1, there is shown a typical illustration of the present invention in a bathroom having a water closet 10 cooperating with the toilet stool 12. Located on the stool 12 is a hollow toilet seat 14 used in combination with a conventional backrest 16.

The hollow toilet seat 14 contains a plurality of openings 18 facing the annular opening of the toilet stool 12, which openings communicate with a hollow core 20 located within the toilet seat 14 and which is more fully illustrated in connection with FIG. 2. The hollow toilet seat 14 may be constructed according to any of the techniques located in the art and as explained and described in the introduction.

The concept of the present invention is to draw volatile gases located within the annular opening of the toilet stool 12 through the openings 18 and through port 20 located within the toilet seat 14 by means of suitable flexible ducting 22. The means for drawing the air may be any suitable device for causing a vacuum, either by pumping means or vacuum means, and in the preferred embodiment is illustrated as a fan 24 located in a separate container 26.

The exhaust air pulled in by fan 24 is forced through a suitable gride device 28 preferably formed of tungsten wires and connected to a source of electricity 30. The exhaust air after passing through the grid device 28 is exhausted into the atmosphere by means of a suitable duct 32.

In the preferred embodiment a pressure sensitive switch 34 illustrated in FIG. 2 is connected in electrical circuit with the fan 24 and the grid 28 in order to turn on the fan and the grid whenever a person places his weight on the seat 14. In this fashion the electrical devices are not operating continuously but only when the toilet stool 12 is being used in the appropriate fashion.

The grid 28 and the motor 24 may operate directly from the 110 volts which is normally found in present-day dwellings or these devices may be operated from a step-down voltage of approximately 12 volts which is obtainable by means of suitable step-down transformer 34.

The inventive concept recognizes the basic principle that the odorous gases from the human body are highly volatile and are presently believed to be of a methane derivative and that it is the volatile nature of the gases that contain the odor that is considered by many to be objectionable.

The inventive concept is concerned therefore with gathering the odorous volatile gases in a confined area and incinerating these gases by passing the gases through the tungsten grid 28 which ignites the gases and allows the burned by-products of combustion to be discharged into the atmosphere.

Since the by-products of combustion are no longer volatile and no longer have any obnoxious smell or odor, it is possible to discharge the burned gases back in the bathroom atmosphere thereby making the present invention highly desirable for use as an add-on device in present bathrooms and especially in what is generally termed in the art today as indoor bathrooms which are defined as those with no exterior wall or exterior windows.

The grid 28 is basically connected across an operating potential and consists of fine tungsten wires interspaced orthogonally with respect to each other in a non-contacting relationship so as to ignite any volatile gas passing through the grid structure. In this fashion all volatile gas passing through will be ignited and burned and all odor associated in connection with the volatile gases will be destroyed.

The practice of the present invention may utilize any incinerating device for igniting the volatile gases and these of course may include an open pilot light or a suitable glow plug which is electrically energized for incinerating the gases.

Referring now to FIG. 2, there is shown a cross-section of the toilet seat which more fully illustrates the port 20 located within the seat 14 and the openings 18 which communicate with the ported opening 20.

While FIG. 2 shows a cross-section of the seat 14, ducting material 22 is shown connected to box 26 mounted on an outside wall 36 by means of through fitting 38 for discharging the burned by-products to the outside atmosphere.

Box 26 contains the pump 24 and the incinerator in the form of the grid structure 28 as described in connection with FIG. 1.

A review of the present invention will show that the odorous volatile gases are gathered from the source and passed through an incinerator which burns the gases and destroys the odor thereby allowing the burned by-products to either be discharged back into the bathroom atmosphere or discharged to the outside atmosphere if the bathroom has an outside wall.

It will be apparent also to those skilled in the art that any kind of incinerating device may be used and, further, any kind of vacuum or pumping device needed to draw the gases from the toilet stool may be used in order to practice the present invention.

In addition, the incinerating device may be electrically operated from high voltage or low voltage and, further, may include either a glow plug or any kind of incinerating device that will ignite a volatile gas.

I claim:

1. A system for removing odorous volatile body gases associated with the use of a toilet stool comprising:

a hollow toilet seat having an annular opening and a plurality of radial openings for providing an air passageway between said annular openings and said hollow toilet seat, an incinerator device comprising electrical discharge circuits in the air passageway for igniting and burning odorous volatile body gases, said electrical discharge circuits consist of a plurality of screen wire located orthogonally and insulated from each other to form a grid, a vacuum device connected by a conduit with said hollow toilet seat and said incinerator device for drawing air from said annular opening through said radial openings through said hollow toilet seat and through said incinerating device whereby the odorous volatile gases are burned and the odor-free by-products in question are discharged into the atmosphere.

2. A system according to claim 1 in which said screen wire is tungsten.

3. A system according to claim 1 in which said electrical discharge circuits are energized with voltage in the order of 12 to 14 volts.

4. A system according to claim 1 in which said vacuum device and said incinerator device are housed in a single container and the products of combustion are vented into a through wall fitting to the outside atmosphere for dispersal.

* * * * *